US005156391A

United States Patent [19]

Roller

[11] Patent Number: 5,156,391

[45] Date of Patent: Oct. 20, 1992

[54] SHORT PAPER PATH ELECTRONIC DESKEW SYSTEM

[75] Inventor: George J. Roller, Penfield, N.Y.

[73] Assignee: Xerox Corporation, Stamford, Conn.

[21] Appl. No.: 787,472

[22] Filed: Nov. 4, 1991

[51] Int. Cl.[5] ..... B65H 7/10

[52] U.S. Cl. ..... 271/227; 271/250; 271/270

[58] Field of Search ..... 271/227, 250, 270

[56] References Cited

U.S. PATENT DOCUMENTS

| | | | |
|---|---|---|---|
| 4,216,482 | 8/1980 | Mason | 346/129 |
| 4,438,917 | 3/1984 | Janssen et al. | 271/227 |
| 4,511,242 | 4/1985 | Ashbee | 271/227 X |
| 4,620,807 | 11/1986 | Polit | 271/274 X |
| 4,805,892 | 2/1989 | Calhoun | 271/225 |
| 4,839,674 | 6/1989 | Hanagata | 271/227 X |
| 4,971,304 | 11/1990 | Lofthus | 271/227 |
| 5,090,683 | 2/1992 | Kamath | 271/227 |

FOREIGN PATENT DOCUMENTS

| | | |
|---|---|---|
| 57-175643 | 10/1982 | Japan . |
| 63-82255 | 4/1988 | Japan . |

*Primary Examiner*—Richard A. Schacher
*Attorney, Agent, or Firm*—Kevin R. Kepner

[57] ABSTRACT

An apparatus and method to deskew sheets in a short paper path in an electrophotographic printing machine by differentially driving two sets of rolls so as to create a paper buckle buffer zone in the sheet and then differentially driving a roll set to correct the skew while the sheet is still within the nips of multiple drive roll sets. Contrary to stalled roll techniques, leading edge damage to sheets is eliminated as the deskewing rolls are initially traveling at the same velocity as the sheet.

10 Claims, 2 Drawing Sheets

SHORT PAPER PATH ELECTRONIC DESKEW SYSTEM

Figure 1:
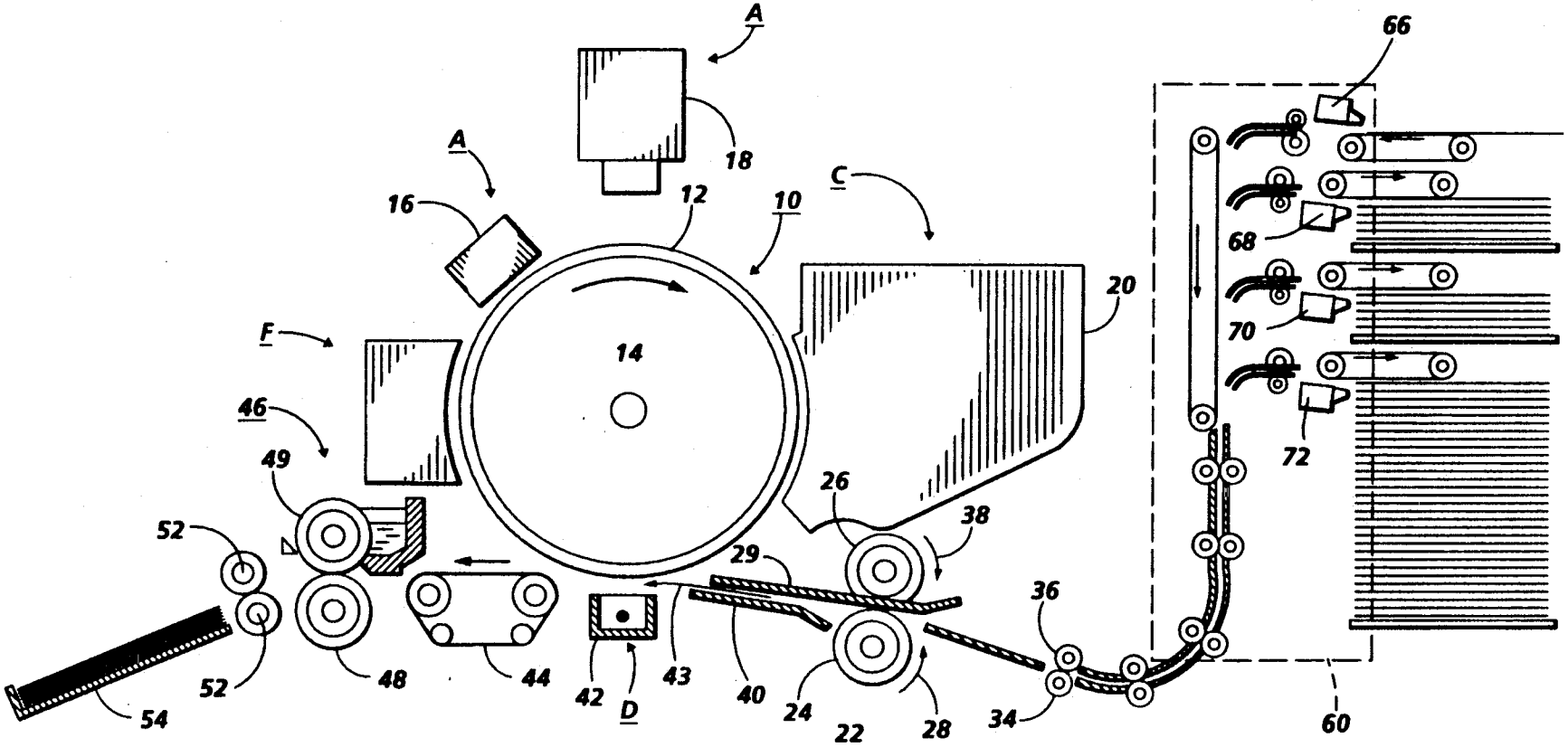

This invention relates generally to a sheet deskewing system, and more particularly concerns a short paper path electronic deskewing system for use in an electrophotographic printing machine.

In a typical electrophotographic printing process a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, paper handling devices of the type including xerographic reproduction machines have incorporated some sort of registration system to properly align sheets of paper passing through these devices. Whether the sheet is a document in a recirculating document handler or a copy sheet in the reproduction processor, registration or alignment of the sheets traveling through a paper path to a known orientation is necessary for the achievement of high quality copying. With particular reference to the reproduction processor, it will be appreciated that registration of copy sheets must include, for example, synchronization of the copy sheet edges with the latent image on the photoreceptor, as well as speed matching with the photoreceptor and transportation of the sheet into the transfer zone or deskewing of improperly fed copy sheets.

In a typical registration transport, a force is applied on the copy sheets to move them to a fixed registration edge as the sheets are simultaneously moved through the machine. In the past, alignment systems have been primarily passive, making use of physical contact with the sheet for alignment generally by providing a fixed position contacting registration member at an appropriate position for a selected registration operation. Such contacting members have included gripper bars, side guides, tamper arrangements, stalled rolls and/or registration fingers. A common weakness in all these devices is the inherent relative motion between the registration member and the sheet during contact. Contact and slippage between registration member and sheet can cause unacceptable damage to the sheet edge, and potential jamming of the machine. In certain finger registration systems, misfeeding may lead to tearing, ripping or holing of the sheet, particularly problematic when handling originals. Additionally, long term contact between passing sheets and the registration member may cause wear of the registration member, leading to long term variance in registration, thereby requiring adjustment or repair of the mechanical members to obtain original registration accuracy. Many of these arrangements often also require extended paper paths to be effective.

The following disclosures may be relevant to various aspects of the present invention:

U.S. Pat. No. 4,971,304; Patentee: Lofthus; Issued: Nov. 20, 1990.

U.S. Pat. No. 4,438,917; Patentee: Janssen, et al.; Issued: Mar. 27, 1984.

U.S. Pat. No. 4,216,482; Patentee: Mason; Issued: Aug. 5, 1980.

JP-63-82255; Patentee: Hiroyoshi Maruyama; Issued: Apr. 13, 1988.

JP-57-175643; Patentee: Eisaku Saiki; Issued: Oct. 28, 1982.

The relevant portions of the foregoing disclosures may be briefly summarized as follows:

U.S. Pat. No. 4,971,304 discloses a method and apparatus for deskewing and side registration in which a sheet with a random skew is driven nondifferentially until skew is measured. The sheet is then driven differential by independent rollers to a known skew and to a side registration point, at which time the sheet is driven differentially to compensate for the known skew.

U.S. Pat. No. 4,438,917 discloses a sheet deskewing arrangement provided with a sensor set arranged along the path of sheets in the processing direction and a pair of selectable controllable motors, each driving a driving nip in a roll pair, supported to contact a side portion of the sheet in driving engagement, to correct skew sensed by the sensors. The two sensors, arranged in a line perpendicular to the path of sheet travel, each detect when the lead edge of a sheet passes thereby. A difference in sensing time of sheet passage by each sensor is indicative of sheet skew, and the two motors are driven in accordance with the difference to accelerate or decelerate a side portion of the sheet, thereby rotating the sheet to bring the lead edge of the sheet into registration.

U.S. Pat. No. 4,216,482 teaches a combination of a hard stopping pivot member and a positive driving arrangement, coupled with fixed and movable sensors to register a sheet.

JP-63-82255 discloses the use of independently driven timing rollers which are rotatable in either a clockwise or counterclockwise direction to align a sheet.

JP-57-175643 describes a stalled roll technique of deskewing whereby the leading edge of a sheet is fed into the bite point of a set of stationary rollers causing the sheet to be deformed and to align by means of force supplied by a paper buckle along the stationary rolls at which time the rolls are activated and the sheet driven to the next station or set of rolls.

The independently driven rolls of the above references require either a long paper path or elaborate nip releases in order to function properly. The stalled roll devices utilize a paper buckle to supply a registration force to the lead edge of a sheet to achieve proper alignment. Additionally, in the case of the stalled roll or fixed pivot point devices, sheet damage is likely to occur, especially when lighter weight sheets are handled.

In accordance with one aspect of the present invention, there is provided an apparatus for deskewing and side registering a sheet. The apparatus comprises means for advancing the sheet along a primary sheet feeding path. Means, operatively associated with the advancing means measures the deviation of the sheet from the primary sheet feeding path when at least a portion of the sheet is positioned within the advancing means. Means, responsive to the measuring means, control the advancing means to restore the sheet to the primary sheet feeding path.

Pursuant to another aspect of the present invention, there is provided an electrophotographic printing machine of the type in which a sheet is deskewed and side registered. The improvement comprises means for advancing the sheet along a primary sheet feeding path. Means, operatively associated with the advancing means measures the deviation of the sheet from the primary sheet feeding path when at least a portion of the sheet is positioned within the advancing means. Means, responsive to the measuring means, control the advancing means to restore the sheet to the primary sheet feeding path.

Figure 2:
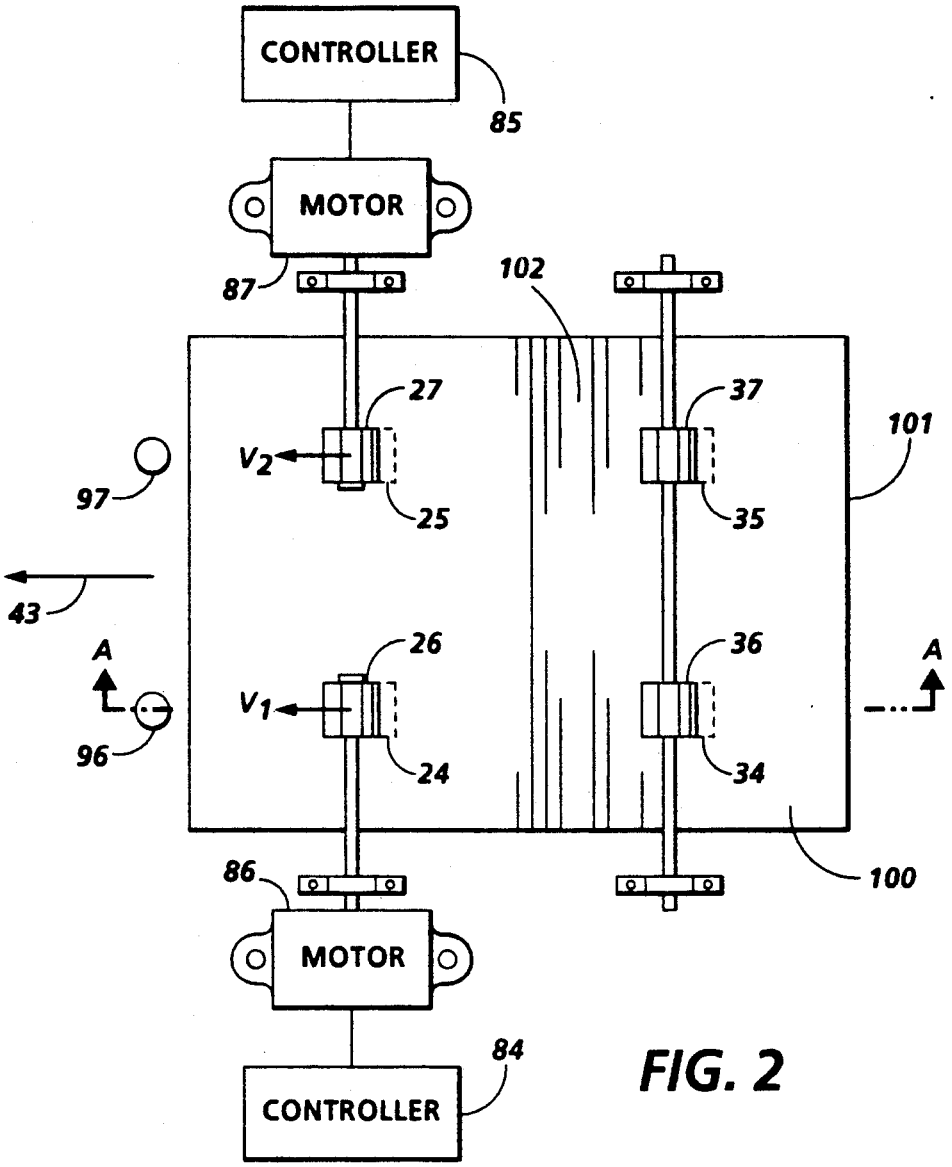
Figure 3:
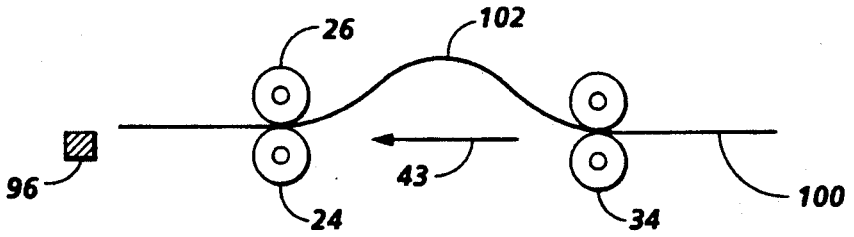

Other features of the present invention will become apparent as the following description proceeds and upon reference to the drawings, in which:

FIG. 1 is a schematic elevational view depicting an illustrative electrophotographic printing machine incorporating the sheet deskewing apparatus of the present invention therein; and FIG. 2 is a top view of the present invention showing the relationship between the sheet sensors, standard drive rolls and independently driven drive rolls of the present invention; and FIG. 3 is a side elevation of FIG. 2 along line A—A showing the buckle in the sheet between the roll sets.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for selecting copy sheets is particularly well adapted for use in the electrophotographic printing machine of FIG. 1, it should become evident from the following discussion that it is equally well suited for use in a wide variety of devices and is not necessarily limited in this application to the particular embodiment shown herein.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a conventional corona generating device, indicated generally by the reference numeral 16, to charge photoconductive surface 12 to a relatively high substantially uniform potential.

Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original documents so as to create incremental light images which are projected through an apertured slit onto the charged portion of photoconductive surface 12. Irradiation of the charged portion of photoconductive surface 12 records an electrostatic latent image corresponding to the informational areas contained within the original document. Obviously, electronic imaging of page image information could be used, if desired.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by sheet feeding apparatus 60 through the paper path which includes drive rolls 34 and 36 to registration roller 24 and idler roller 26. Registration roller 24 is driven by a motor (not shown) in the direction of arrow 28 and idler roller 26 rotates in the direction of arrow 38 since roller 26 is in contact therewith. In operation, feed device 60 operates to advance the copy sheet from the selected tray through the guide and path along which rolls 34 and 36 are located and then into registration roller pairs 24, 26 and 25, 27 such that the sheet is forwarded toward the drum 12 in synchronism with the image of the drum. The sheet is advanced in the direction of arrow 43 through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the deskewing system in greater detail.

Turning now to FIG. 2, the relationship of the commonly driven roll pairs 34, 36 and 35, 37, the independently driven roll pairs 24, 26 and 25, 27, and the sheet sensors 96 and 97 can be seen. A sheet 100 is shown in the control of both sets of drive rolls and is traveling in the direction noted by arrow 43.

The deskew roll pairs 24, 26 and 25, 27 are driven at a speed equal to the drive roll pairs 34, 36 and 35, 37 in the direction 43 as the sheet enters the nips of the deskew roll pairs 24, 26 and 25, 27. After the sheet 100 enters the deskew roll nips, the deskew roll pairs 24, 26 and 25, 27 slow, creating a paper buckle 102 between the deskew roll pairs and the preceding set of drive rolls 34, 36 and 35, 37. Sensors 96 and 97 determine skew angle of the sheet and direct the motor controllers 84, 85 to adjust the speed of the independent drive motors 86, 87, of the deskew roll pairs 24, 26 and 25, 27 so as to bring the sheet 100 into proper alignment. As a result of the buffer zone created by the paper buckle 102, it is not necessary that the trailing edge 101 of the sheet 100 have passed through the prior set of drive rolls 34, 36 and 35, 37, nor is it necessary that any elaborate or complicated nip release mechanisms be utilized to allow the sheet to be deskewed without damage to the sheet. The sheet buckle isolates the motion occurring in the deskew nips.

The paper buckle buffer zone is illustrated in FIG. 3, which is a side view of FIG. 2 taken along line A—A. It is important to note that in the present invention the buckle 102 illustrated in FIG. 3 is not used to provide an alignment force as in the stalled rolled techniques of prior inventions. Rather, the buckle 102 acts solely as a buffer zone to prevent damage to the sheet 100 while the deskew roll pairs 24, 26 and 25, 27 are correcting the alignment of the sheet 100. Since the deskew rolls 24, 26 and 25, 27 initially are rotating at the same speed as the preceding drive rolls 34, 36 and 35, 37, there is no damage to the lead edge of the sheet as it enters the nips of the deskew rolls 24, 26 and 25, 27, even for very lightweight sheets.

It is furthermore possible to also provide for a side registration alignment through the use of the sensors of the present invention so as to cause the sheet to be aligned at a precise lateral position as it is passing through the deskew rolls. The advantage of the this method is the elimination of the necessity for a registration edge, which edges are usually stationery and have the potential for sheet damage as a result of the relative movement between the edges and the sheet.

In recapitulation, there is provided a method for short paper path deskewing, which involves utilizing a set of independently driven deskew rolls. The deskew rolls are initially driven at a speed equal to the prior sheet transport rolls until the sheet enters the nips of the deskew rolls. After the sheet enters the deskew rolls, the deskew rolls slow, causing a paper buckle or buffer zone to be formed between the deskew rolls and the prior drive rolls. Sensors mounted immediately after the deskew rolls determine the skew angle of the sheet and signal the independently driven deskew roll motor controllers to adjust speed so as to bring the sheet into proper alignment. Due to the buffer zone created by the buckle between the deskew rolls and the prior set of drive rolls, it is not necessary that the trailing edge of the sheet have passed beyond the prior drive rolls nor are any complicated nip release mechanisms necessary. It is further possible to utilize the deskew rolls and sensors to insure proper lateral alignment or side registration of the sheet without the necessity of a fixed registration guide which has the potential for damage to the sheet.

It is, therefore, apparent that there has been provided in accordance with the present invention, an apparatus and method that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for deskewing and side registering a sheet comprising:

a plurality of drive roller sets for advancing the sheet along a primary sheet feeding path with successive ones of said plurality of drive roller sets being positioned at discrete locations along the primary sheet feeding path, and each of said plurality of drive roller sets defining a nip through which the sheet advances;

means, operatively associated with said plurality of drive roller sets, for measuring the deviation of the sheet from the primary sheet feeding path with portions of the sheet being positioned substantially simultaneously within the nip defined by sucessive ones of said plurality of drive roller sets; and means, responsive to said measuring means, for controlling said drive roller sets to restore the sheet to the primary sheet feeding path.

2. The apparatus according to claim 1, wherein said plurality of drive roller sets comprises:

a first set of drive rolls;

first means for driving each drive roll of said first of drive rolls at a common speed;

a second set of drive rolls positioned after said first set of drive rolls, along the sheet feeding path; and second means for driving each drive roll of said second set of drive rolls independently.

3. An apparatus according to claim 2, wherein said controlling means regulates the speed of the rolls of said second drive roll set to be substantially equal to the speed of the rolls of said first drive roll set and, subsequently, to decrease the speed of the rolls of said second drive roll set to be less than the speed of the rolls of said first drive roll set so as to form a buckle in the sheet between said first drive roll set and said second drive roll set.

4. An apparatus according to claim 3, wherein said measuring means comprises a plurality of optical sensors disposed in the sheet path.

5. An electrophotographic printing machine of the type in which a sheet is deskewed and side registered, wherein the improvement comprises:

a plurality of drive roller sets for advancing the sheet along a primary sheet feeding path with successive ones of said plurality of drive roller sets being positioned at discrete locations along the primary sheet feeding path, and each of said plurality of drive roller sets defining a nip through which the sheet advances;

means, operatively associated with said plurality of drive roller sets, for measuring the deviation of the sheet from the primary sheet feeding path with portions of the sheet being positioned substantially simultaneously within the nip defined by successive ones of said plurality of drive roller sets; and means, responsive to said measuring means, for controlling said drive roller sets to restore the sheet to the primary sheet feeding path.

6. The apparatus according to claim 5, wherein said plurality of drive roller sets comprises:

a first set of drive rolls;

first means for driving each drive roll of said first of drive rolls at a common speed;

a second set of drive rolls positioned after said first set of drive rolls, along the sheet feeding path; and second means for driving each drive roll of said second set of drive rolls independently.

7. An apparatus according to claim 6, wherein said controlling means regulates the speed of the rolls of said second drive roll set to be substantially equal to the speed of the rolls of said first drive roll set and, subsequently, to decrease the speed of the rolls of said second drive roll set to be less than the speed of the rolls of said first drive roll set so as to form a buckle in the sheet between said first drive roll set and said second drive roll set.

8. An apparatus according to claim 7, wherein said measuring means comprises a plurality of optical sensors disposed in the sheet path.

9. The apparatus of claim 8, wherein the sheet being fed is a copy sheet.

10. The apparatus of claim 8, wherein the sheet being fed is an original document.

* * * * *